US005579843A

United States Patent [19]

Loitherstein

[11] Patent Number: 5,579,843

[45] **Date of Patent: *Dec. 3, 1996**

[54] RESILIENT SPIDER FOR WELL INSTALLATION

[76] Inventor: Joel S. Loitherstein, 76 Warren Rd., Ashland, Mass. 01722

[ * ] Notice: The term of this patent shall not extend beyond the expiration date of Pat. No. 5,465,791.

[21] Appl. No.: 444,194

[22] Filed: May 18, 1995

Related U.S. Application Data

[63] Continuation-in-part of Ser. No. 291,375, Aug. 16, 1994, Pat. No. 5,465,791.

[51] Int. Cl.[6] ..... E21B 43/04

[52] U.S. Cl. ..... 166/278; 166/51; 166/202

[58] Field of Search ..... 166/380, 51, 278, 166/202, 241.6, 241.4, 382, 177, 241.1

[56] References Cited

U.S. PATENT DOCUMENTS

| | | | |
|---|---|---|---|
| 602,547 | 4/1898 | Titus . | |
| 2,781,100 | 2/1957 | Pyle et al. | 166/173 |
| 3,039,534 | 6/1962 | Koop | 166/202 X |
| 3,231,021 | 1/1966 | Greene, Jr. | 166/117 |
| 4,066,125 | 1/1978 | Bassani | 166/202 |
| 4,133,398 | 1/1979 | Still | 175/171 |
| 4,287,948 | 9/1981 | Haggard | 166/170 |
| 4,306,620 | 12/1981 | Fronius | 166/241.6 |
| 5,247,990 | 9/1993 | Sudol et al. | 166/241.6 |

FOREIGN PATENT DOCUMENTS

| | | | |
|---|---|---|---|
| 1694867 | 11/1991 | Russian Federation | 166/51 |
| 9216717 | 10/1992 | WIPO | 166/51 |

*Primary Examiner*—Hoang C. Dang
*Attorney, Agent, or Firm*—Hamilton, Brook, Smith & Reynolds, P.C.

[57] ABSTRACT

A resilient spider is mounted on a monitoring well section and has extension arms which, in a flexed condition, allow a desired vertical movement of the monitoring well relative to an auger in a borehole, and in an unflexed condition, may be used to secure the monitoring well in circumdisposed relationship to the lower end of the auger.

11 Claims, 10 Drawing Sheets

RESILIENT SPIDER FOR WELL INSTALLATION

RELATED APPLICATION

This application is a continuation-in-part of U.S. Ser. No. 08/291,375 filed Aug. 16, 1994, now the U.S. Pat. No. 5,465,791.

BACKGROUND OF THE INVENTION

This invention relates to the installation of monitoring wells. A typical monitoring well consists of a series of riser pipe sections connected end to end which terminates in a well screen section followed by an end cap. During well installation, the operation of securing the monitoring well tubing or pipe in a borehole while the borehole is backfilled with sand and cement is often hampered by the upward buoyant force of groundwater located in the borehole. A need exists for a device for securing a monitoring well pipe in a borehole in the presence of a buoyant force due to groundwater.

SUMMARY OF THE INVENTION

According to the present invention, a spider is provided which, in a flexed condition, allows a desired downward vertical movement of a monitoring well pipe relative to an auger to occur, and in an unflexed condition, may be used to secure the monitoring well pipe in circumdisposed relationship to the lower end of the auger. The spider includes a circular planar base having an opening which in a particular embodiment, may be frictionally circumferentially mounted on a monitoring well pipe section. In a preferred embodiment, a circular planar base includes an opening for mounting on a threaded portion of a well pipe section or on an unthreaded portion of an end plug which presses into one end of the well pipe section. The preferred embodiment includes a flange extending around the diameter of the opening which may be mounted over the outer diameter of the well pipe section. The spider also includes a plurality of resilient arms which are integral to the base and which normally extend radially outwardly therefrom. The resilient arms are of sufficient length such that in their unflexed position, they overlap the rim of the lower end of the auger, holding the monitoring well pipe section against the auger while sand or other material is backfilled over the arms. The resilient arms of the spider may also be flexed upwardly relative to the base. The diameter of the spider in the flexed condition is less than the inner diameter of the auger. Thus, the monitoring well pipe with the spider mounted may be lowered vertically through the auger when the spider is in the flexed condition.

The above and other features of the invention including various novel details of construction will now be more particularly described with reference to the accompanying drawings and pointed out in the claims. It will be understood that the particular spider embodying the invention is shown by way of illustration only and not as a limitation of the invention. The principles and features of this invention may be employed in varied and numerous embodiments without departing from the scope of the invention.

DETAILED DESCRIPTION OF THE INVENTION

Figure 1B:
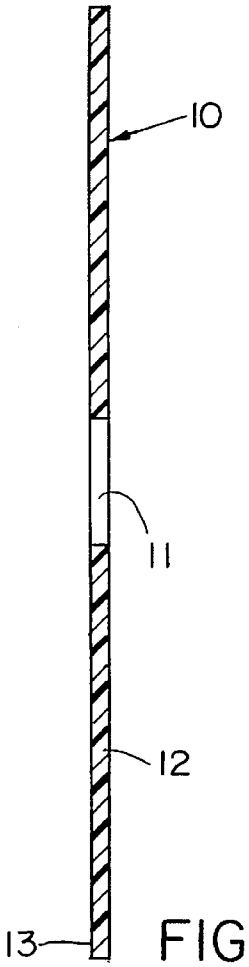
FIG. 1B is a sectional side view of the spider of FIG. 1A taken along line I—I.
Figure 1A:
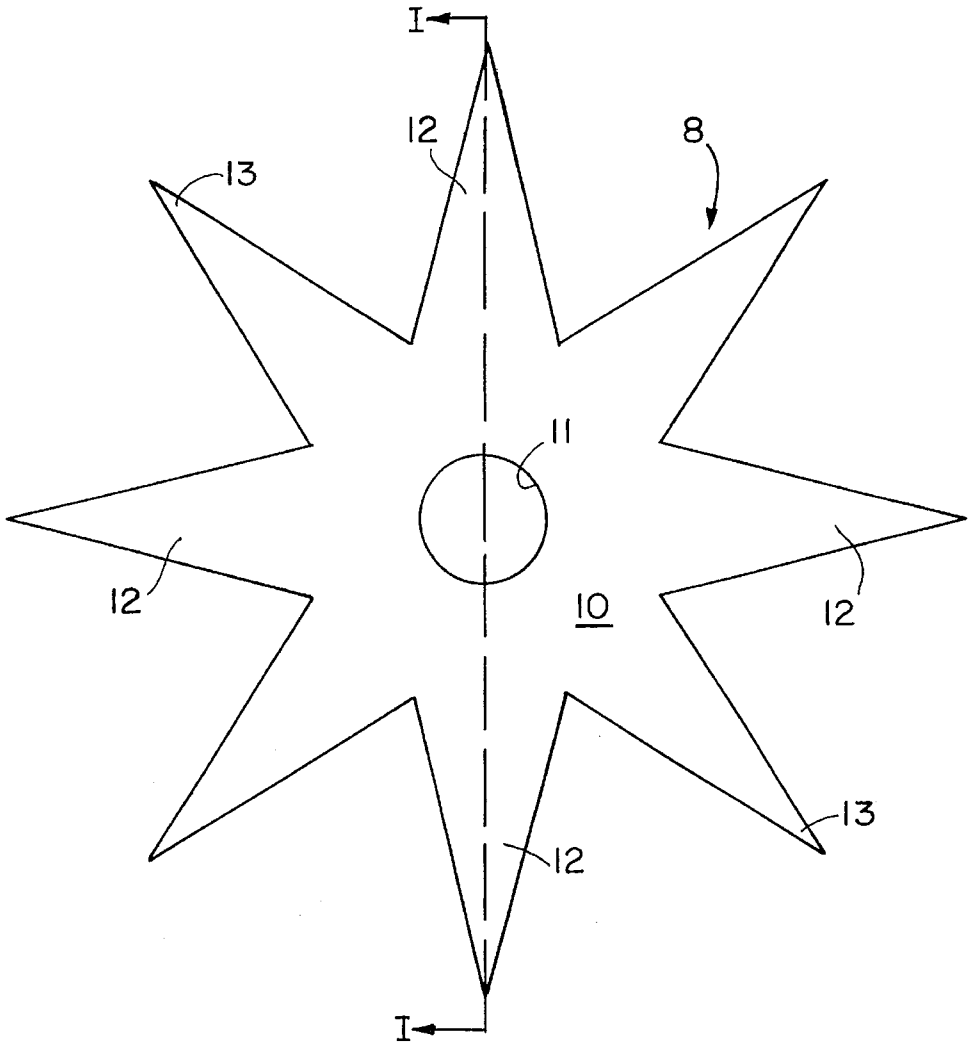
FIG. 1A is a plan view of a first embodiment of a spider of the present invention.
Figure 2:
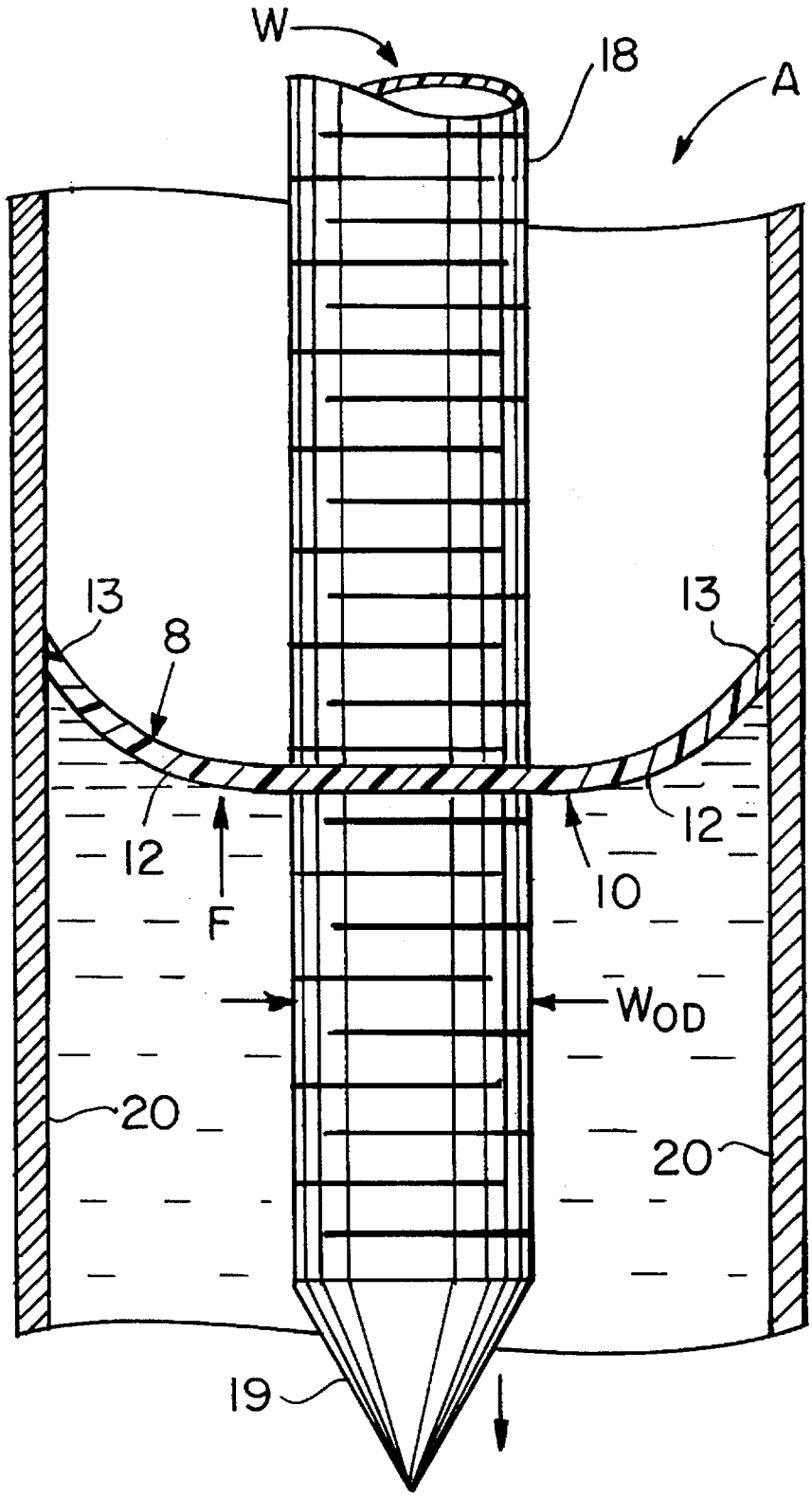
FIG. 2 is a cross-sectional elevation view of the spider of FIG. 1A mounted on a well pipe section disposed between the inner walls of an auger.

Reference is now made to FIGS. 1A, 1B and 2 which illustrate a first embodiment of the present invention. A flexible spider 8 has an inner circular planar base portion 10 and an outer peripheral portion in the form of flexible extension arms 12 which are integral to the base portion 10 (FIG. 1A). The base portion 10 provides a lateral opening 11 for receiving a well pipe section 18 (FIG. 2). Although the spider 8 as presently illustrated optionally has eight extension arms, equally spaced from each other, a greater or lesser number of arms may be used. While the resilient spider arms 12 are optionally shown as being triangular in shape, other shapes, such as rectangular or oblong may also be used. The spider 8 is preferably made from a resilient plastic material such as high density polyethylene, of approximately ⅛ inch thickness, and is of molded construction. Each spider arm 12 terminates in an actuating portion 13 (FIG. 1B).

The lateral opening 11 of the base portion 10 is adapted to fit snugly about a well pipe section 18 (FIG. 2) of a cylindrical monitoring well pipe W having an outer diameter $W_{OD}$, A well end plug or cap 19 is formed at the lower end of the well pipe section to prevent sand from entering into the monitoring well. When the spider 8 is being used, a cylindrical hollow stem auger A is circumdisposed about the well pipe section 18 in substantially concentric relationship thereto. In a flexed condition, as illustrated in FIG. 2, the spider arms 12 frictionally contact auger inner walls 20 and are flexed upwardly so that the monitoring well pipe W can move vertically through the auger A. In an unflexed condition, the spider 8 may be used to secure the monitoring well pipe W in circumdisposed relationship to the lower end of the auger A such that the unflexed spider arms 12 overlap the end of the auger A. The installation operation will be described further below.

Figure 4:
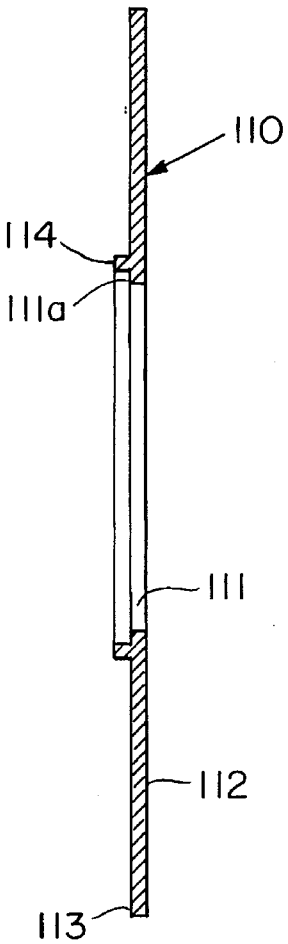
FIG. 4 is a sectional side view of the spider of FIG. 3 taken along line IV—IV.
Figure 3:
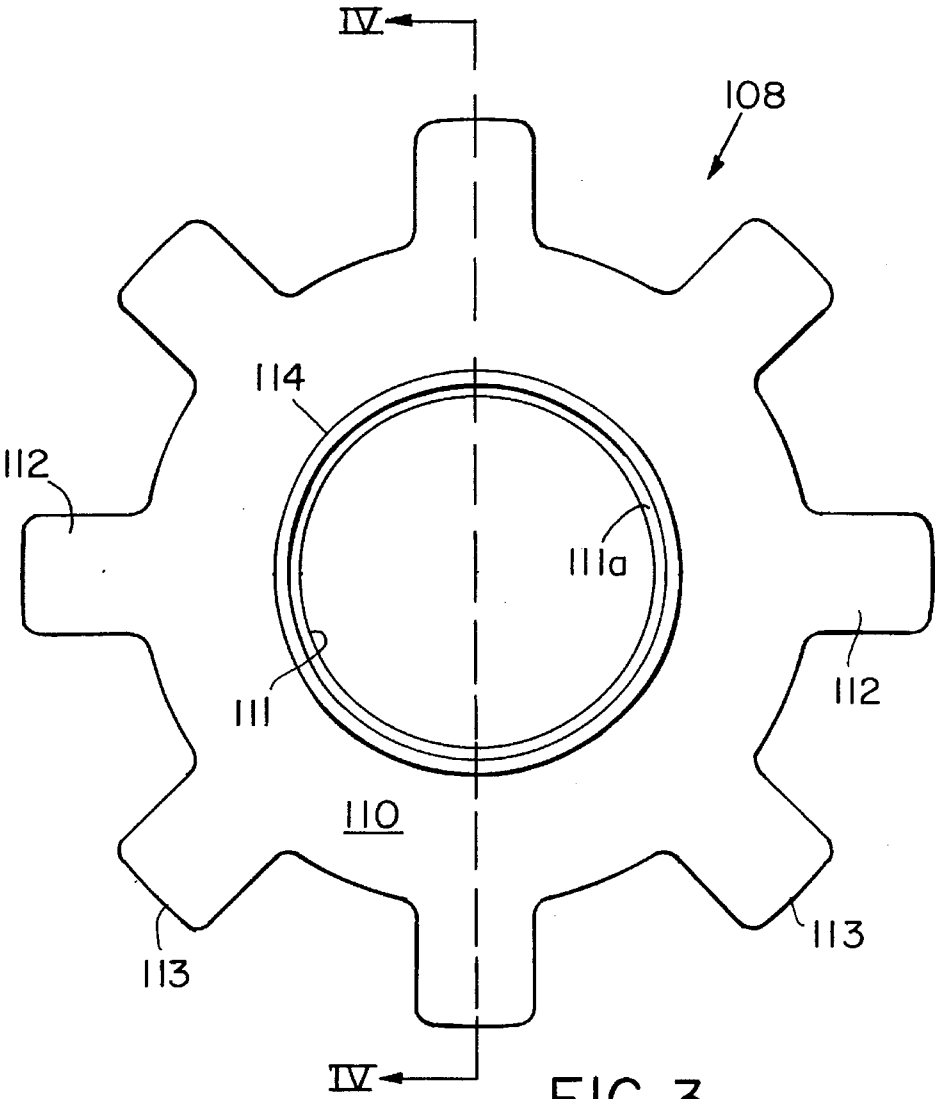
FIG. 3 is a plan view of a preferred embodiment of the present invention.
Figure 5:
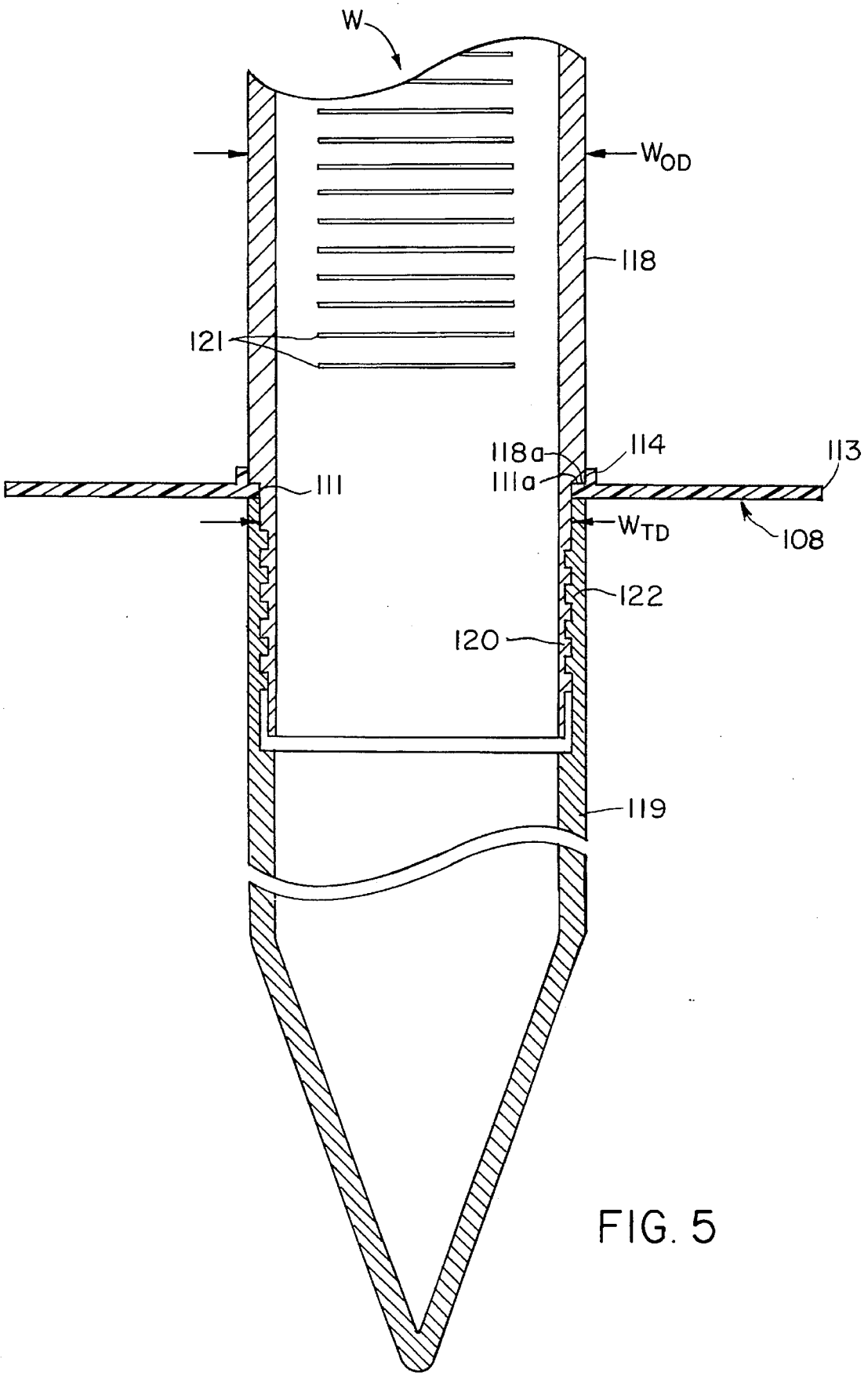
FIG. 5 is a cross-sectional elevation view of the spider of FIG. 3 mounted on a threaded end of a well pipe section.

A preferred embodiment spider 108 is illustrated in FIGS. 3 to 5. The spider 108 includes a circular planar base portion 110 and a peripheral portion in the form of flexible extension arms 112 which are integral to the base portion 110 (FIG. 3). Each extension arm 112 terminates in an actuating portion 113. The base portion 110 has a lateral opening 111 adapted for receiving a threaded end of a monitoring well pipe section 118 (FIG. 5). The spider 108 includes a flange 114 which extends around the diameter of the lateral opening 111. A shoulder portion 111*a* is formed between the flange 114 and the opening 111.

As shown in FIG. 5, the lateral opening 111 may be mounted about the threaded end 120 of a well pipe section 118 of a cylindrical monitoring well pipe W having an outer diameter $W_{OD}$ and thread outside diameter $W_{TD}$. The well pipe section 118 includes a shoulder portion 118*a* which abuts the shoulder portion 111*a* of the spider 108. The threaded end 120 is mated to a threaded end 122 of a well end cap 119. As the threaded end 122 is threaded onto threaded end 120, the shoulder portion 111*a* becomes sandwiched between the shoulder portion 118*a* of well pipe section 118 and the threaded end 122 of well end cap 119, thus securing the spider 108 in position. Alternatively, the lateral opening 111 may be mounted about an unthreaded extension of an end plug (not shown) which is press fitted into an unthreaded end of a well pipe section. In either mounting arrangement, the inside diameter of the flange 114 is adapted for mounting around the outside diameter $W_{OD}$ of the well pipe section 118 and thereby strengthens the base portion 110 for installation purposes.

A preferred well pipe section 118 is that portion known as a well screen, which is typically the bottom section of the monitoring well. The well screen includes a series of lateral slots 121 for keeping out the sand pack made up of sand with a nominal diameter greater than 0.02 inches. The sand pack helps screen out silt and sediment having a nominal diameter less than 0.02 inches. The well pipe section 118 may also be a section of riser pipe which typically connects above the well screen and is unslotted.

The present invention is particularly suited for the installation of monitoring wells. While the monitoring well pipe W may typically have an outer diameter $W_{OD}$ of about 2½ inches, the cylindrical hollow stem auger A may typically have an inner diameter $A_{ID}$ of about four inches and an outer diameter $A_{OD}$ of about six inches.

Figure 6:
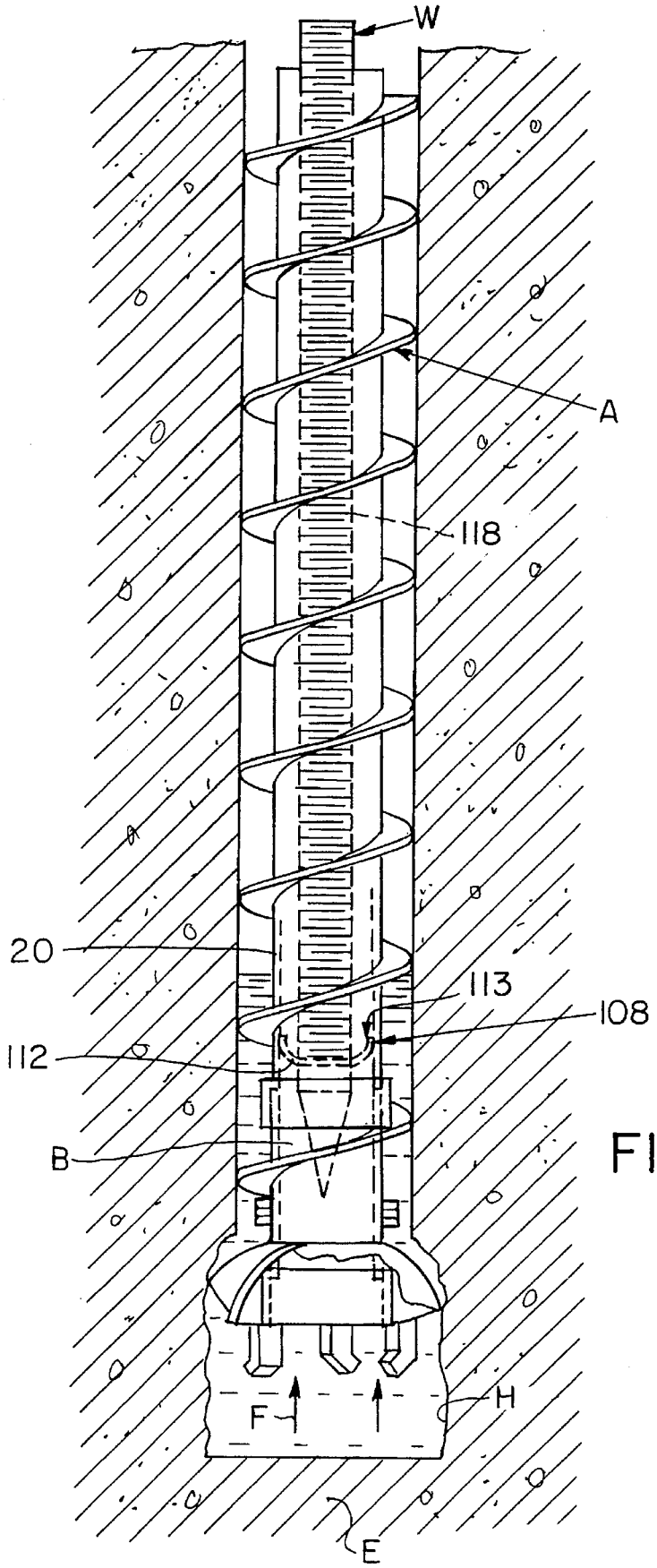
FIG. 6 is an elevation view, partly in cross-section, of the spider of FIG. 3 mounted on a well pipe section being moved vertically relative to the auger.

The operation of the spider 108 will now be described in detail with reference to FIGS. 6 to 10. In a monitoring well installation, the auger A having a bit B is used to form a borehole H in stratum E (FIG. 6). The monitoring well pipe W, made up of multiple screen or riser sections and having the spider 108 attached to a particular well pipe section 118, is placed into the upper end of the auger and pushed downward through the auger. FIG. 6 illustrates the spider in the flexed condition as the monitoring well pipe W is pushed downward through the auger A. The actuating portion 113 of each resilient spider arm 112 frictionally contacts the inner walls 20 of the auger A, and the downward vertical movement of the monitoring well pipe W causes the spider arms 112 to flex upwardly. The lateral diameter of the spider 108 in the flexed condition is substantially coincident with the inner diameter $A_{ID}$ of the auger. The frictional contact of the resilient spider arms 112 with the auger walls 20 opposes an upward buoyant force F due to groundwater located in the borehole.

Figure 7:
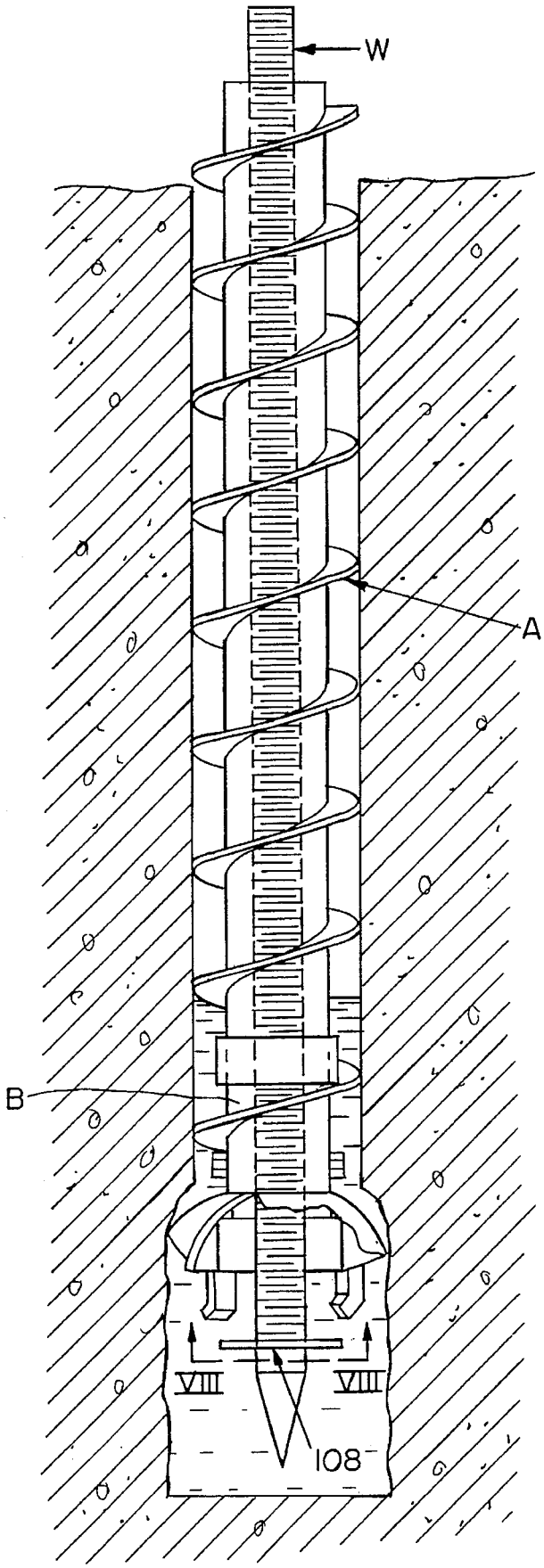
FIG. 7 is a view similar to FIG. 6 but showing the spider arms in the unflexed position when the monitoring well pipe is positioned below the lower end of the auger.
Figure 8:
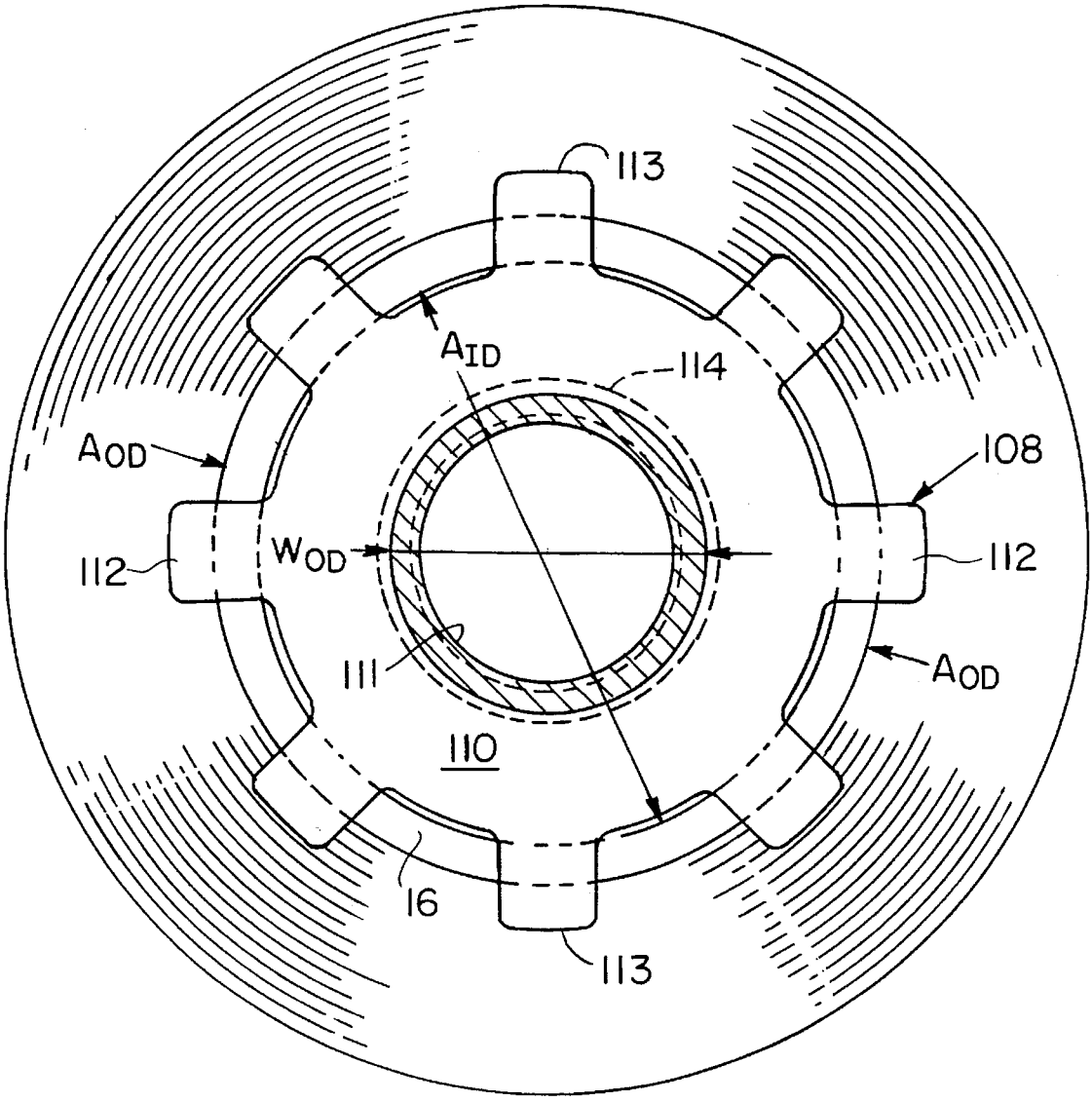
FIG. 8 is a bottom plan view, partly in cross-section, taken on the line VIII—VIII of FIG. 7.
Figure 9:
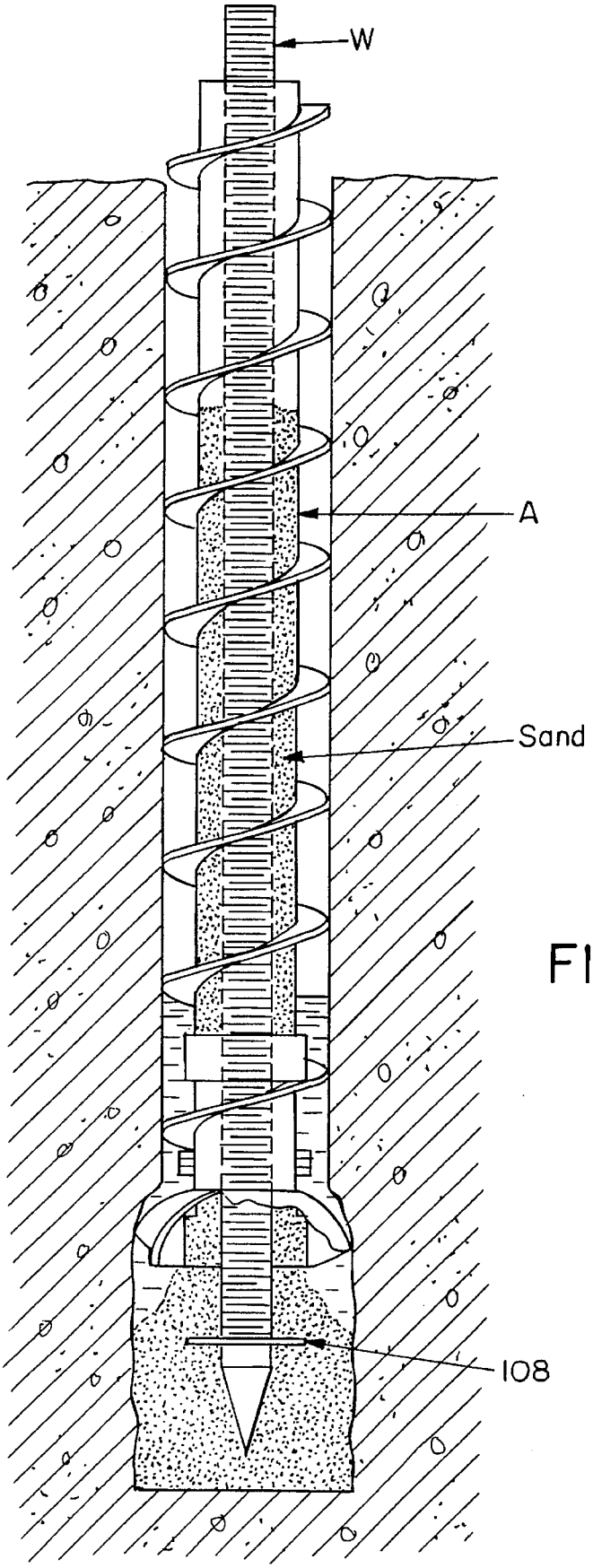
FIG. 9 is a view similar to FIG. 7 showing sand backfill added to hold the monitoring well pipe in position.

When the monitoring well pipe W is pushed to a point where the spider 108 is positioned below the lower end of the auger A, the resilient arms 112 return to their unflexed condition (FIG. 7). The resilient arms 112 are of sufficient length such that in their unflexed condition, they overlap the auger rim 16 as shown in the sectional view of FIG. 8. With the spider 108 positioned below the lower end of the auger A, the buoyant force F of the groundwater causes the unflexed spider arms 112 to contact the auger rim 16, thereby securing the monitoring well pipe W in circumdisposition thereto. With the spider 108 securing the well pipe in circumdisposed relationship to the auger, and after the auger is retracted slightly, sand backfill may be introduced into the hollow auger so as to rest upon the upper horizontal surface of the spider arms 112, thereby further securing the monitoring well pipe W in the borehole (FIG. 9).

Figure 10:
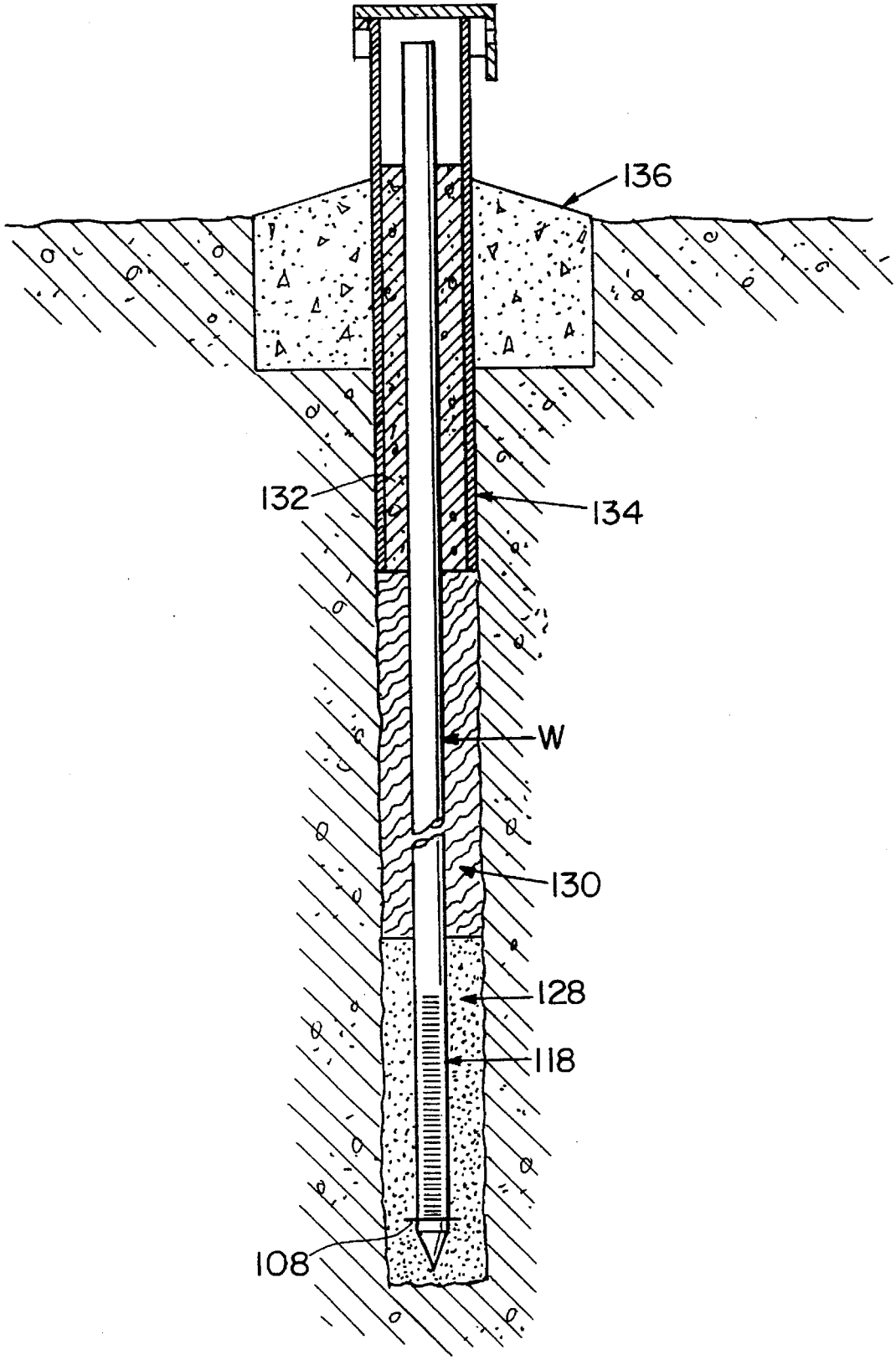
FIG. 10 is a view similar to FIG. 9 showing a finished monitoring well installation.

Once secured, the monitoring well installation can be completed, as shown in FIG. 10, by adding further material layers as the auger is completely retracted. A layer 130 of a bentonite/clay mixture on top of the sand filter layer 128 provides an impervious seal. Above the bentonite/clay layer 130, there typically rests a layer 132 of low permeability backfill. A protective casing 134 surrounding the low permeability backfill layer 132 protects the upper end of the monitoring well pipe W which projects above the ground surface level. A surface seal material 136 typically made of concrete provides the top layer to seal the finished monitoring well.

Figure 11:
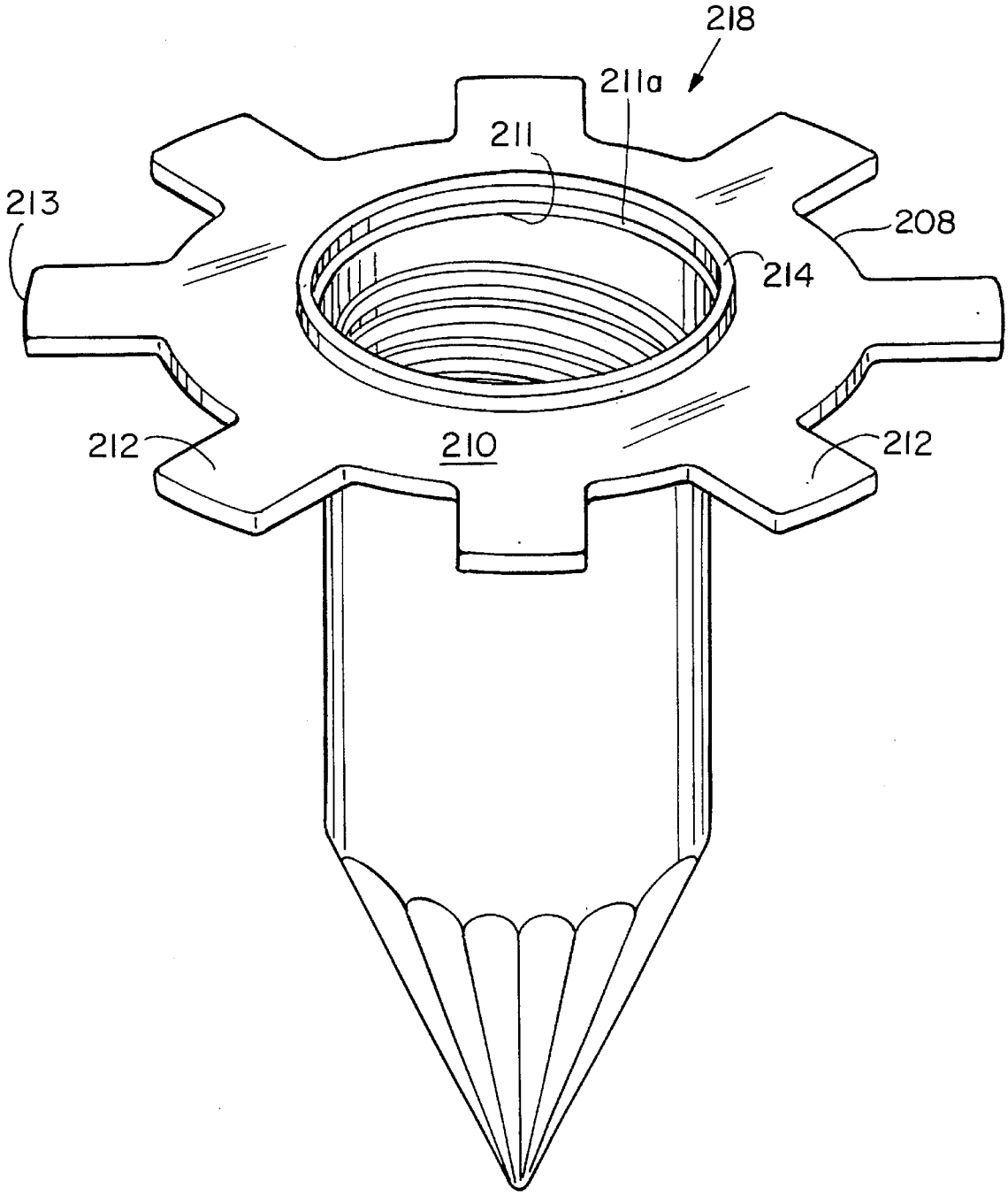
FIG. 11 is a perspective view of a third embodiment of a spider integrally formed in a well pipe section.

In a third embodiment of the present invention, illustrated in FIG. 11, a well pipe section end plug or end cap 218 includes an integrally formed spider 208. The integrally formed spider 208 includes a circular planar base portion 210 and a peripheral portion in the form of resilient flexible extension arms 212 which are integral to the base portion 210. The extension arms 212 terminate in actuating portions 213. The base portion 210 has a lateral opening 211 adapted for receiving a threaded end of a monitoring well pipe section. The spider 208 includes a flange 214 which extends around the diameter of the lateral opening 211. A shoulder portion 211*a* is formed between the flange 214 and the opening 211. The integral spider 208 operates in a substantially similar manner as previously described for the preferred embodiment.

Equivalents

Those skilled in the art will know, or be able to ascertain using no more than routine experimentation, many equivalents to the specific embodiments of the invention described herein. These and all other equivalents are intended to be encompassed by the following claims.

What is claimed is:

1. In a monitoring well installation wherein a borehole is made by an auger having an inner wall and an outer rim, apparatus comprising:

a monitoring well pipe; and a spider comprising:

a circular planar base having an opening mounted on a lower section of the monitoring well pipe; and a plurality of resilient arms extending radially outwardly from the base which in one operating condition frictionally engage the inner wall of the auger and in another operating condition overlap the rim of the auger.

2. The apparatus of claim 1 wherein the spider is formed of resilient plastic.

3. The apparatus of claim 2 wherein the spider is formed of high density polyethylene.

4. The apparatus of claim 1 wherein the lower section of the monitoring well pipe comprises:

a first well pipe section having a threaded end; and a second well pipe section having an end for receiving the threaded end of the first well pipe section;

the spider being disposed between the first and second well pipe sections.

5. The apparatus of claim 1 further comprising a flange extending around the diameter of the opening adapted for mounting on the outside diameter of the monitoring well pipe.

6. In a monitoring well installation wherein a borehole is made by an auger having an inner wall and an outer rim, apparatus comprising:

a first well pipe section having a threaded end;

a second well pipe section having an end for receiving the threaded end of the first well pipe section; and a spider disposed between the first and second well pipe sections comprising:

a circular planar base having a lateral opening mounted on the threaded end of the first well pipe section; and a plurality of resilient arms extending radially outwardly from the base which in one operating condition frictionally engage the inner wall of the auger and in another operating condition overlap the rim of the auger.

7. The apparatus of claim 6 wherein the spider further comprises a flange extending around the diameter of the lateral opening and mounted on the outside diameter of the first well pipe section.

8. The apparatus of claim 6 wherein the spider is formed of high density polyethylene.

9. A method of installing a monitoring well pipe in a borehole made by an auger having inner walls and an outer rim, comprising the steps of:

mounting a spider between first and second well sections of the monitoring well pipe, the first well section having a threaded end and the second well section having an end for receiving the threaded end of the first well section, wherein the spider comprises a circular planar base having an opening for such mounting and a plurality of resilient arms integral to the base and extending radially outwardly therefrom which in one operating condition are adapted for frictionally engaging the inner walls of the auger and opposing an upward buoyant force of groundwater located in the borehole, and in another operating condition are adapted for overlapping the rim of the lower end of the auger and being circumdisposed thereto;

pushing the monitoring well pipe with the spider mounted thereupon downward through the auger located in a borehole such that the inner walls of the auger are frictionally engaged by the spider arms; and positioning the spider mounted on the monitoring well pipe below the lower end of the auger such that the monitoring well pipe is supported against the rim of the lower end of the auger by the upward buoyant force of the groundwater located in the borehole.

10. The method of claim 9 wherein the spider is formed of resilient plastic.

11. The method of claim 10 wherein the spider is formed of high density polyethylene.

* * * * *